US010731447B2

(12) United States Patent
Fehri

(10) Patent No.: US 10,731,447 B2
(45) Date of Patent: Aug. 4, 2020

(54) COILED TUBING SUPPORTED ESP WITH GAS SEPARATOR AND METHOD OF USE

(71) Applicant: BAKER HUGHES, A GE COMPANY, LLC, Houston, TX (US)

(72) Inventor: Ahmed Fehri, Tunis (TN)

(73) Assignee: BAKER HUGHES, A GE COMPANY, Houston, TX (US)

( * ) Notice: Subject to any disclaimer, the term of this patent is extended or adjusted under 35 U.S.C. 154(b) by 66 days.

(21) Appl. No.: 16/147,636

(22) Filed: Sep. 29, 2018

(65) Prior Publication Data

US 2019/0234193 A1 Aug. 1, 2019

Related U.S. Application Data

(60) Provisional application No. 62/625,045, filed on Feb. 1, 2018.

(51) Int. Cl.

| | |
|---|---|
| ***E21B 43/12*** | (2006.01) |
| ***E21B 43/38*** | (2006.01) |
| ***E21B 47/06*** | (2012.01) |
| ***F04B 47/06*** | (2006.01) |

(52) U.S. Cl.

CPC ..... *E21B 43/128* (2013.01); *E21B 43/38* (2013.01); *F04B 47/06* (2013.01)

(58) Field of Classification Search

CPC ..... E21B 43/128; E21B 43/38; F04B 47/06; F04D 13/10

See application file for complete search history.

(56) References Cited

U.S. PATENT DOCUMENTS

| | | | | |
|---|---|---|---|---|
| 5,516,360 | A | 5/1996 | Normandeau et al. | |
| 7,343,967 | B1 | 3/2008 | Floyd | |
| 9,181,785 | B2 | 11/2015 | Lawson et al. | |
| 2002/0096327 | A1 | 7/2002 | Kobylinski et al. | |
| 2003/0111230 | A1 | 6/2003 | Olson et al. | |
| 2003/0145989 | A1* | 8/2003 | Shaw | E21B 43/128 166/265 |
| 2010/0089588 | A1 | 4/2010 | Thompson | |
| 2012/0132414 | A1 | 5/2012 | Lawson et al. | |
| 2013/0068455 | A1 | 3/2013 | Brown et al. | |
| 2017/0254172 | A1 | 9/2017 | Mack et al. | |

OTHER PUBLICATIONS

The International Search Report and Written Opinion for related PCT application PCT/US2018/055562 dated Jan. 14, 2019.

* cited by examiner

*Primary Examiner* — David J Bagnell
*Assistant Examiner* — Yanick A Akaragwe
(74) *Attorney, Agent, or Firm* — Bracewell LLP; James E. Bradley

(57) ABSTRACT

An assembly for pumping well fluid from a well includes a production conduit string having a polished bore receptacle. A coiled tubing segment with a power cable is suspended within the production conduit string. A motor, which is secured to the coiled tubing segment and electrically connected with the power cable, drives a pump. The pump discharge opens into a coiled tubing annulus between the coiled tubing segment and production conduit string. A gas separator has a heavier fluid outlet leading into the pump intake and a lighter fluid outlet leading into the production conduit string below the polished bore receptacle. A seal member extends between the gas separator and the pump in sealing engagement with the polished bore receptacle above the lighter fluid outlet and below the pump discharge.

19 Claims, 2 Drawing Sheets

COILED TUBING SUPPORTED ESP WITH GAS SEPARATOR AND METHOD OF USE

CROSS-REFERENCE TO RELATED APPLICATION

This application claims priority to provisional application Ser. No. 62/625,045, filed Feb. 1, 2018.

FIELD OF THE DISCLOSURE

This disclosure relates in general to electrical submersible pumps (ESP) for wells and in particular to an inverted ESP supported on coiled tubing power cable and having a gas separator.

BACKGROUND

Electrical submersible pumps are often used to pump fluids from hydrocarbon wells. An ESP normally includes a motor, a pump, and a seal section that reduces a pressure differential between well fluid on the exterior and dielectric lubricant in the motor interior. In many installations, the ESP secures to the lower end of a string of production tubing, made up of sections of pipe secured together with threaded ends. A power cable strapped alongside the production tubing extends from the surface to the motor.

For maintenance or replacement, normally, a workover rig is required to retrieve the ESP because the production tubing must be pulled. A conventional power cable cannot support its own weight in many wells, thus needs additional support if production tubing is not utilized. One technique involves placing the power cable within coiled tubing, which is a continuous length of metal tubing deployed from a reel. A coiled tubing injecting unit will lower the coiled tubing power cable and an inverted ESP down production tubing until an intake tube on the lower end of the pump stabs and seals into a polished bore receptacle in the production tubing. The pump discharges up an annular space in the production tubing surrounding the coiled tubing.

Many hydrocarbon bearing wells produce gas along with liquid, principally oil and water. The gas is detrimental to the efficiency of the most common type of pump, which is a centrifugal pump. A gas separator may be incorporated with the ESP in conventional installations with the ESP supported on production tubing. The gas separator may be various types, such as rotary or vortex, and it vents separated lighter components, such as gas, into the annulus between the production tubing and the casing in the well.

SUMMARY

An assembly for pumping well fluid from a well includes a production conduit string having a polished bore receptacle. A coiled tubing segment, suspended within the production conduit string, has a power cable therein. A motor secures to the coiled tubing segment and electrically connects with the power cable. A pump operably connects to the motor, the pump having a pump intake and a pump discharge. The pump discharge opens into a coiled tubing annulus between the coiled tubing segment and production conduit string. A gas separator operably connects to the pump for separating well fluid into a heavier fluid component and a lighter fluid component. The gas separator has an inlet for receiving well fluid flowing into the production conduit string. The gas separator has a heavier fluid outlet leading into the pump intake and a lighter fluid outlet leading into the production conduit string below the polished bore receptacle. A seal member between the gas separator and the pump sealingly engages the polished bore receptacle above the lighter fluid outlet and below the pump discharge.

In the embodiment shown, a production conduit port below the polished bore receptacle leads from an interior of the production conduit string to an outer annulus surrounding the production conduit string for flowing the lighter fluid components into the outer annulus. The production conduit port is above the lighter fluid outlet of the gas separator. In one embodiment, a sliding sleeve mounts to the production conduit string. The sleeve is movable between a closed position closing the production conduit port to an open position opening the production conduit port.

The pump has a pump drive shaft rotated by the motor. In the embodiment shown, the gas separator comprises a gas separator shaft operably connected with the pump drive shaft for rotation therewith. A blade mounts to the gas separator shaft for rotation therewith.

The seal member may have an upper end secured to a lower end of the pump and a lower end secured to an upper end of the gas separator. The seal member may have a seal member shaft coupled between the pump shaft and the gas separator shaft.

In the embodiment shown, the gas separator has a maximum outer diameter less than a minimum inner diameter of the polished bore receptacle, defining an annular clearance between the gas separator and the polished bore receptacle as the gas separator is lowered through the polished bore receptacle.

The seal member may be free to move up and down a limited extent relative to the polished bore receptacle while maintaining sealing engagement with the polished bore receptacle. The heavier fluid outlet of the gas separator discharges into an interior of the seal member.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
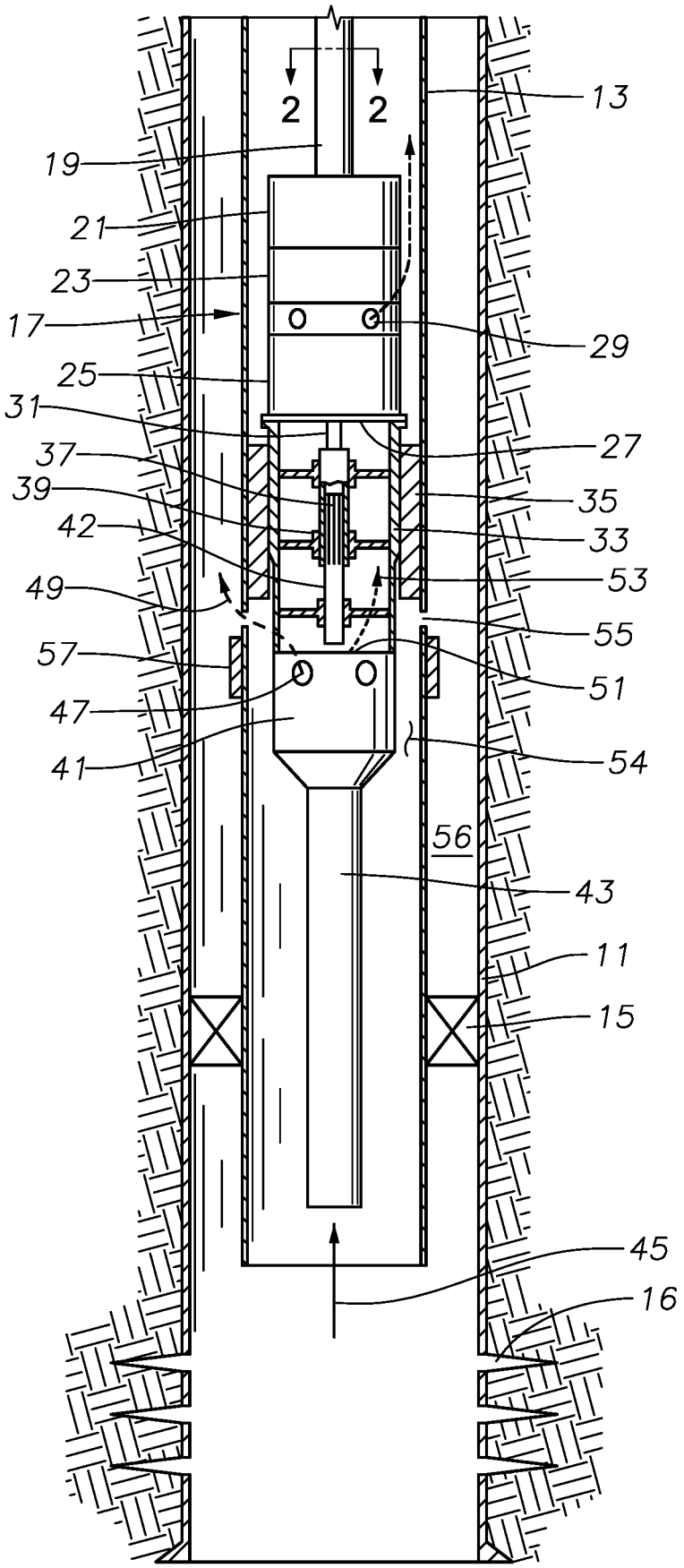
FIG. 1 is a schematic view of an inverted ESP having a gas separator and supported by a coiled tubing power cable in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, the well includes casing 11, which will be cemented in place. In the embodiment shown, a tubular liner, conduit or production tubing 13 extends through the casing 11. Production tubing 13 is of a conventional type, having sections secured together by threads. A packer 15 near the lower end of production tubing 13 seals between production tubing 13 and casing 11. Perforations 16 in casing 11 below packer 15 admit well fluid into casing 11 and the open lower end of production tubing 13.

A string of coiled tubing power cable 19 supports an inverted electrical submersible pump (ESP) 17 within production tubing 13. Coiled tubing power cable 19 extends to a wellhead at the surface and provides power to ESP 17. ESP 17 includes a motor 21, which has an adapter on its upper end that secures to the lower end of coiled tubing power cable 19. Motor 21 is typically a three-phase electrical motor filled with a dielectric lubricant for lubricating the bearings within it. A seal section or pressure equalizer 23 secures to the lower end of motor 21 in this example. Seal section 23 has a movable element, such as a bag or bellows that is in fluid communication with the lubricant in motor 21 and reduces a pressure differential between the lubricant in motor 21 and the well fluid on the exterior.

At least one pump 25 secures to the lower end of the seal section 23. Pump 25 may be a centrifugal type having a large number of stages, each stage having an impeller and a diffuser. Alternately, pump 25 may be another type, such as a progressing cavity type. Pump 25 has a pump intake 27 on its lower end and a pump discharge 29 near its upper end. A pump shaft 31 extends through pump 25 and couples to a drive shaft in motor 21 for rotation in unison. A thrust bearing may be incorporated in seal section 23, or a separate module may be used for absorbing thrust imposed on pump shaft 31 by the stages in pump 25.

A seal member 33 is at the lower end of pump 25. In this example, seal member 33 is a separate module from pump 25 and is secured by a threaded connection to pump 25, such as a bolt and flange connection. Seal member 33 has a cylindrical seal surface on its exterior that fits into sealing engagement with a cylindrical polished surface in a polished bore receptacle 35. Polished bore receptacle 35 may be secured in the string of production tubing 13 while production tubing 13 is being lowered into casing 11. Seal member 33 has a seal member shaft 37 that has a splined upper end that couples to a splined lower end of pump shaft 31. Bearings 39 provide support for seal member shaft 37.

While installing ESP 17, seal member 33 will slide into and sealingly engage polished bore receptacle 35. Seal member 33 does not land on any structure in polished bore receptacle 35 in this embodiment. Rather coiled tubing power cable 19 continues to support the weight of ESP 17, which allows slight upward and downward movement of seal member 33 relative to polished bore receptacle 35 due to thermal growth and shrinkage.

A gas separator 41 is at the lower end of seal member 33. In this example, seal member 33 is also a separate module from gas separator 41 and secured by a threaded connection to gas separator 41, such as a bolt and flange connection. In this embodiment, gas separator 41 has a gas separator drive shaft 42 with a splined upper end that couples to seal member shaft 37. The coupling arrangement of gas separator drive shaft 42, seal member drive shaft 37 and pump shaft 31 is only schematically shown.

Gas separator 41 has a tail pipe 43 on its lower end that serves as an inlet for admitting well fluid as indicated by arrow 45. The outer diameters of gas separator 41 and tail pipe 43 are smaller than the maximum outer diameter of the seal surface on seal member 33 and the inner diameter of polished bore receptacle 35. While installing ESP 17, gas separator 41 will pass downward through polished receptacle 35 without sealing engagement. An annular clearance will exist between the maximum outer diameter of gas separator 41 and the inner diameter of polished bore receptacle 35.

Gas separator 41 may be a variety of conventional types and has components that separate lighter or gaseous components of the well fluid from heavier or liquid components of the well fluid. Gas separator has a lighter component outlet 47 on its exterior side wall that discharges the lighter well fluid components, as indicated by arrow 49. Gas separator 41 has a heavier component outlet 51 on its upper end that discharges into the interior of seal member 33, as indicated by arrow 53. The interior of seal member 33 comprises a flow passage for the heavier components to flow into pump intake 27.

Lighter component outlet 47 discharges into an inner annulus 54 surrounding gas separator 41 that is closed at its upper end by the sealing engagement of seal member 33 in polished bore receptacle 35. Production tubing 13 has tubing ports 55 that allow the lighter components of the well fluid to flow out inner annulus 54 into an outer annulus 56 between production tubing 13 and casing 11 above packer 15. The lighter components are free to flow up outer annulus 56 to the wellhead (not shown) for collection.

In this embodiment, tubing ports 55 may be selectively opened and closed by a sliding sleeve 57 mounted to the exterior of production tubing 13 adjacent tubing ports 55. Control lines (not shown) allow an operator to move sliding sleeve 57 axially between the open position shown to a closed position blocking tubing ports 55. The operator may place sliding sleeve 57 in the closed position while ESP 17 is either not running or not installed in production tubing 13. The operator will place sliding sleeve 57 in the open position while ESP 17 is running.

In operation, an operator will first install production tubing 13 and packer 15 along with polished bore receptacle 35 and sliding sleeve 57. The operator then employs a coiled tubing injection unit to lower ESP 17 along with seal member 33 and gas separator 41 on coiled tubing power cable 19 to a position where seal member 33 is in sealing engagement with the interior of polished bore receptacle 35.

The operator then supplies power to motor 21, which drives pump 25 and gas separator 41. Well fluid indicated by arrow 45 flows from perforations 16 up tail pipe 43. Gas separator 41 separates lighter components of the well fluid from heavier components, discharging the lighter components out lighter component outlet 47 into inner annulus 54. As indicated by arrow 49, the lighter components flow out the open tubing ports 55 into outer annulus 56. The heavier components of the well fluid flow up the interior of seal member 33 to pump intake 27, as indicated by arrow 53.

Pump 25 applies pressure to the heavier components of well fluid, discharging them into production tubing 13 in the annulus surrounding coiled tubing power cable 19.

Figure 2:
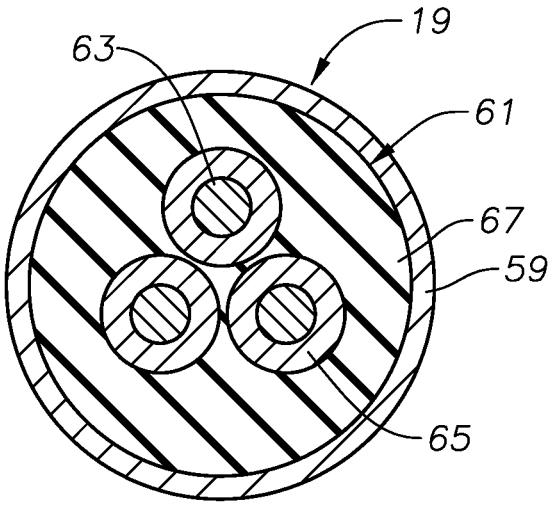
FIG. 2 is a sectional view of the coiled tubing power cable taken along the line 2-2 of FIG. 1.

Referring to FIG. 2, coiled tubing power cable 19 may be of various configurations. In this example, power cable coiled tubing 19 includes coiled tubing 59, which is a continuous length of steel tubing that may be coiled on a large reel at the surface. Coiled tubing 59 contains a power cable 61, which in this example, includes three electrical conductors 63. A separate insulation layer or layers 65 surrounds each conductor 63. An elastomeric jacket 67 surrounds all three insulated conductors 63. Optionally, a helical strip of metal armor (not shown) may be wrapped around jacket 67. Power cable 61 may be installed in coiled tubing 59 while coiled tubing 59 is being rolled from a strip and seam welded. Swage rollers will then swage the coiled tubing 59 to a smaller diameter in tight frictional engagement with power cable 61. Alternately, power cable 61 may be pulled into previously formed coiled tubing 59.

Figure 3:
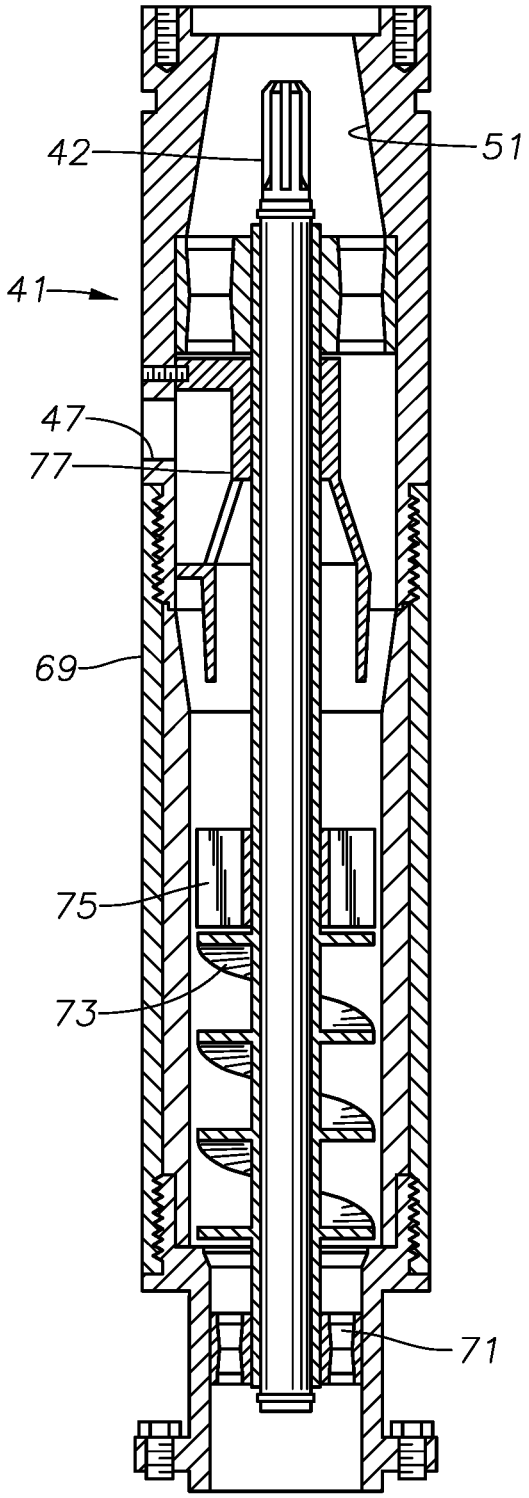
FIG. 3 is a longitudinal cross sectional view of one example of the gas separator of FIG. 1.

FIG. 3 illustrates one example of gas separator 41. Gas separator 41 has a tubular housing 69 containing bearings 71 that support gas separator drive shaft 42. Gas separator 41 may have an inducer 73, which is a helical flight or blade that rotates with drive shaft 42 to push the well fluid upward. A non-rotating guide vane 75, which may be one or more flat or curved plates, imparts a swirling motion to the well fluid discharged by inducer 73. The swirling motion causes heavier components to flow outward to the inner diameter of housing 69, while the lighter components remain in a central area. A crossover 77 diverts the lighter components out lighter component outlet 47. Crossover 77 directs the heavier components out the heavier component outlet 51 on its upper end.

While the disclosure has been shown in only one of its forms, it should be apparent to those skilled in the art that it is not so limited, but is susceptible to various changes without departing from the scope of the claims.

The invention claimed is:

1. An assembly for pumping well fluid from a well, comprising:

a production conduit string;

a polished bore receptacle mounted into the production conduit string;

a coiled tubing segment suspended within the production conduit string, the coiled tubing segment having a power cable therein;

a motor secured to the coiled tubing segment and electrically connected with the power cable;

a pump operably connected to the motor, the pump having a pump intake and a pump discharge, the pump discharge opening into a coiled tubing annulus between the coiled tubing segment and production conduit string;

a gas separator operably connected to the pump for separating well fluid into a heavier fluid component and a lighter fluid component, the gas separator having an inlet for receiving well fluid flowing into the production conduit string, the gas separator having a heavier fluid outlet leading into the pump intake and a lighter fluid outlet leading into the production conduit string below the polished bore receptacle;

a seal member between the gas separator and the pump in sealing engagement with the polished bore receptacle above the lighter fluid outlet and below the pump discharge; and a production conduit port below the polished bore receptacle and leading from an interior of the production conduit string to an outer annulus surrounding the production conduit string for flowing the lighter fluid component to the outer annulus.

2. The assembly according to claim 1, wherein:

the production conduit port is above the lighter fluid outlet of the gas separator.

3. The assembly according to claim 1, further comprising:

a sliding sleeve mounted to the production conduit string, the sleeve being movable between a closed position closing the production conduit port to an open position opening the production conduit port.

4. The assembly according to claim 1, wherein:

the pump has a pump drive shaft rotated by the motor;

the gas separator comprises:

a gas separator shaft operably connected with the pump drive shaft for rotation therewith; and a blade mounted to the gas separator shaft for rotation therewith.

5. The assembly according to claim 1, wherein the heavier fluid outlet of the gas separator discharges into an interior of the seal member.

6. An assembly for pumping well fluid from a well, comprising:

a production conduit string;

a polished bore receptacle mounted into the production conduit string;

a coiled tubing segment suspended within the production conduit string, the coiled tubing segment having a power cable therein;

a motor secured to the coiled tubing segment and electrically connected with the power cable;

a pump operably connected to the motor, the pump having a pump intake and a pump discharge, the pump discharge opening into a coiled tubing annulus between the coiled tubing segment and production conduit string;

a gas separator operably connected to the pump for separating well fluid into a heavier fluid component and a lighter fluid component, the gas separator having an inlet for receiving well fluid flowing into the production conduit string, the gas separator having a heavier fluid outlet leading into the pump intake and a lighter fluid outlet leading into the production conduit string below the polished bore receptacle;

a seal member between the gas separator and the pump in sealing engagement with the polished bore receptacle above the lighter fluid outlet and below the pump discharge; wherein:

the pump has a pump drive shaft rotated by the motor;

the gas separator has a gas separator shaft;

the seal member has an upper end secured to a lower end of the pump and a lower end secured to an upper end of the gas separator; and the seal member has a seal member shaft coupled between the pump shaft and the gas separator shaft.

7. An assembly for pumping well fluid from a well, comprising:

a production conduit string;

a polished bore receptacle mounted into the production conduit string;

a coiled tubing segment suspended within the production conduit string, the coiled tubing segment having a power cable therein;

a motor secured to the coiled tubing segment and electrically connected with the power cable;

a pump operably connected to the motor, the pump having a pump intake and a pump discharge, the pump discharge opening into a coiled tubing annulus between the coiled tubing segment and production conduit string;

a gas separator operably connected to the pump for separating well fluid into a heavier fluid component and a lighter fluid component, the gas separator having an inlet for receiving well fluid flowing into the production conduit string, the gas separator having a heavier fluid outlet leading into the pump intake and a lighter fluid outlet leading into the production conduit string below the polished bore receptacle;

a seal member between the gas separator and the pump in sealing engagement with the polished bore receptacle above the lighter fluid outlet and below the pump discharge; and wherein the gas separator has a maximum outer diameter less than a minimum inner diameter of the polished bore receptacle, defining an annular clearance between the gas separator and the polished bore receptacle as the gas separator is lowered through the polished bore receptacle.

8. An assembly for pumping well fluid from a well, comprising:

a production conduit string;

a polished bore receptacle mounted into the production conduit string;

a coiled tubing segment suspended within the production conduit string, the coiled tubing segment having a power cable therein;

a motor secured to the coiled tubing segment and electrically connected with the power cable;

a pump operably connected to the motor, the pump having a pump intake and a pump discharge, the pump discharge opening into a coiled tubing annulus between the coiled tubing segment and production conduit string;

a gas separator operably connected to the pump for separating well fluid into a heavier fluid component and a lighter fluid component, the gas separator having an inlet for receiving well fluid flowing into the production conduit string, the gas separator having a heavier fluid outlet leading into the pump intake and a lighter fluid outlet leading into the production conduit string below the polished bore receptacle;

a seal member between the gas separator and the pump in sealing engagement with the polished bore receptacle above the lighter fluid outlet and below the pump discharge; and wherein the seal member is free to move up and down a limited extent relative to the polished bore receptacle while maintaining sealing engagement with the polished bore receptacle.

9. An assembly for pumping well fluid from a well, comprising:

a production conduit string;

a polished bore receptacle mounted into the production conduit string, the polished bore receptacle having an inner diameter smaller than an inner diameter of the production conduit string;

a production conduit port extending through a side wall of the production conduit string below the polished bore receptacle;

a coiled tubing segment suspended within the production conduit string, the coiled tubing segment having a power cable therein;

a motor secured to a lower end of the coiled tubing segment and electrically connected with the power cable;

a pump operably connected to the motor below the motor, the pump having a pump discharge above the polished bore receptacle and leading to a coiled tubing annulus between the coiled tubing segment and production conduit string;

a tubular seal member connected to a lower end of the pump and having an outer diameter surface in sealing engagement with the inner diameter of the polished bore receptacle, the seal member having a flow passage therethrough that leads to the pump; and a gas separator connected to a lower end of the seal member, the gas separator having components for separating well fluid into a heavier fluid component and a lighter fluid component, the gas separator having an inlet for receiving well fluid flowing into the production conduit string below the production conduit port, the gas separator having a heavier fluid outlet leading into the flow passage in the seal member for delivery to the pump, the gas separator having a lighter fluid outlet opening into the production conduit string below the polished bore receptacle.

10. The assembly according to claim 9, further comprising:

a sliding sleeve mounted to the production conduit string, the sleeve being movable between a closed position closing the production conduit port to an open position opening the production conduit port.

11. The assembly according to claim 9, wherein:

the pump has a pump drive shaft rotated by the motor;

the gas separator has a gas separator shaft; and the seal member has a seal member shaft coupled between the pump shaft and the gas separator shaft.

12. The assembly according to claim 9, wherein the gas separator has a maximum outer diameter less than the outer diameter surface of the seal member, enabling the gas separator to be lowered through the polished bore receptacle without sealing engagement with the polished bore receptacle.

13. The assembly according to claim 9, wherein the seal member is free to move up and down a limited extent relative to the polished bore receptacle while maintaining sealing engagement with the polished bore receptacle.

14. A method of producing well fluid from a well, comprising:

mounting a polished bore receptacle into a production conduit string;

providing an electrical submersible pump (ESP) with a motor, a pump, a gas separator and a seal member;

lowering the ESP on a coiled tubing segment into the production conduit string until the gas separator is below the polished bore receptacle and the seal member is in sealing engagement with the polished bore receptacle;

operating the ESP, drawing well fluid into the production conduit string;

with the gas separator, separating heavier fluid components of the well fluid from lighter fluid components, delivering the heavier fluid components to the pump and the lighter fluid components into the production conduit string below the polished bore receptacle; and pumping the heavier fluid components up the production conduit string.

15. The method according to claim 14, further comprising:

providing a port in the production conduit string; and flowing the lighter fluid components delivered by the gas separator out the port into an outer annulus surrounding the production conduit string.

16. The method according to claim 14, further comprising:

providing a port in the production conduit string;

mounting a sliding sleeve to the production conduit string adjacent the port;

while the ESP is operating, placing the sliding sleeve in an open position and flowing the lighter fluid components delivered by the gas separator out the port into an outer annulus surrounding the production conduit string; and while the ESP is not operating, placing the sliding sleeve in a closed position blocking the port.

17. The method according to claim 14, further comprising:

providing the seal member with a shaft; and while operating the ESP, rotating the shaft within the seal member.

18. The method according to claim 14, further comprising:

allowing upward and downward limited movement of the seal member within the polished bore receptacle while the ESP is operating.

19. The method according to claim 14, wherein:

lowering the ESP into the production conduit string comprises passing the gas separator through the polished bore receptacle without sealing engagement of the gas separator with the polished bore receptacle.

* * * * *